US005666586A

United States Patent [19]

Nishimura et al.

[11] Patent Number: 5,666,586

[45] Date of Patent: Sep. 9, 1997

[54] APPARATUS FOR INSTALLING A TONER CARTRIDGE

[75] Inventors: Toshinori Nishimura; Yukio Hashimoto, both of Osaka, Japan

[73] Assignee: Mita Industrial Co. Ltd., Osaka, Japan

[21] Appl. No.: 681,440

[22] Filed: Jul. 23, 1996

[30] Foreign Application Priority Data

Jul. 31, 1995 [JP] Japan ..... 7-195077

[51] Int. Cl.[6] ..... G03G 15/08

[52] U.S. Cl. ..... 399/13; 399/106; 399/110; 399/262; 222/DIG. 1

[58] Field of Search ..... 399/12, 13, 27, 399/29, 102, 106, 110, 119, 126, 262; 141/363, 364; 222/DIG. 1

[56] References Cited

U.S. PATENT DOCUMENTS

| | | | |
|---|---|---|---|
| 4,933,718 | 6/1990 | Furuya | 399/13 |
| 5,049,930 | 9/1991 | Okano et al. | 399/12 |
| 5,103,259 | 4/1992 | Saitoh et al. | 399/13 |
| 5,142,335 | 8/1992 | Sakata et al. | 399/106 |
| 5,289,243 | 2/1994 | Sakamoto | 399/119 |
| 5,475,479 | 12/1995 | Hatakeyama et al. | 399/119 |
| 5,510,884 | 4/1996 | Bov, Jr. et al. | 399/120 |
| 5,523,822 | 6/1996 | Tsuda | 399/13 |

FOREIGN PATENT DOCUMENTS

| | | |
|---|---|---|
| 61-156164 | 7/1986 | Japan . |
| 1-069251 UM | 5/1989 | Japan . |
| 1-079060 UM | 5/1989 | Japan . |
| 2-242277 | 9/1990 | Japan . |
| 4-042258 | 2/1992 | Japan . |
| 4-338989 | 11/1992 | Japan . |
| 4-338990 | 11/1992 | Japan . |
| 7-199574 | 8/1995 | Japan . |
| 8-152782 | 6/1996 | Japan . |

*Primary Examiner*—Matthew S. Smith

*Attorney, Agent, or Firm*—Shinjyu Office of Patent Attorneys

[57] ABSTRACT

A toner cartridge installation unit for an image forming device is disclosed which allows proper toner cartridge installation to take place. The installation unit includes at least one detection slot, and the toner cartridge includes a detection member. If the proper toner cartridge has been selected, or if certain foreign objects have not fallen into the installation unit, the detection member will slide into the detection slot, and a switch within the detection slot will be activated, thereby allowing installation to be completed. If the wrong toner cartridge has been chosen, or if certain foreign objects have fallen into the installation device, the switch will not be activated, the installation unit will discharge the toner cartridge from the image forming device, and the user will be alerted.

14 Claims, 12 Drawing Sheets

APPARATUS FOR INSTALLING A TONER CARTRIDGE

BACKGROUND OF THE INVENTION

1. Field of the Invention

The present invention relates to a device for installing a toner cartridge in an image forming device. In particular it relates to a device for installing a toner cartridge in an image forming device which determines whether the proper toner cartridge is being installed in the image forming device and whether the toner cartridge is properly engaged therein.

2. Description of the Related Art

In an image forming device such as a copying machine or a facsimile device, an electrostatic latent image is formed on a photosensitive drum, and toner is adhered to the electrostatic latent image to form a toner-developed image. A developing device disposed adjacent to the photosensitive drum is provided with a toner hopper for supplying toner, and toner replenishment can be carried out by replacing a toner cartridge which is detachably connected to the toner hopper.

When large, oversized toner cartridges are to be inserted into an image forming device, an automatic toner cartridge installation device may be included. In this type of image forming device, the removal and replacement of the toner cartridge can be carried out by giving instructions to a drive motor in the installation device. For example, when a new toner cartridge is to be inserted into the image forming device, instructions to install the toner cartridge may be input into an operation panel on the image forming device, and the drive motor will then automatically move the toner cartridge into the engaged position in the developing device.

With these types of image forming devices, a manufacturer will often use a single type of toner cartridge for many different models of image forming devices, but the type of toner stored in the toner cartridge will often vary. Therefore, when the wrong toner cartridge is mistakenly inserted into the image forming device, an optimal image may not be obtained. Moreover, when one attempts to install a different type of toner cartridge into an image forming device, the installation device may attempt to force the toner cartridge to move into the engaged position and therefore may cause damage.

In addition, image forming devices which have this type of installation device often also have a toner cartridge installation port which is located on the upper surface of the image forming device. When the toner installation port is located here, it sometimes happens that pencils, pens or other foreign objects accidentally fall into the installation port. If this occurs and is not noticed by the user, the toner cartridge installation device may become jammed, or damage may occur to the image forming device during the installation or removal of the toner cartridge.

SUMMARY OF THE INVENTION

It is therefore an object of the present invention to provide a toner cartridge installation device which prevents an unsuitable toner cartridge from being installed into an image forming device.

Another object of the present invention is to prevent damage to an image forming device when foreign objects accidentally fall into a toner cartridge installation device.

According to one aspect of the present invention, an apparatus for installing a toner cartridge in an image forming device includes a toner cartridge installing means, for moving a toner cartridge from a mount/dismount position in an image forming device into an installed position in the image forming device, a determination means for determining whether the toner cartridge may be properly installed in the image forming device, and a toner cartridge discharging means for returning the toner cartridge back to the mount/dismount position when the determination means has determined that the toner cartridge is not properly installed in the image forming device.

According to another aspect of the present invention, the toner cartridge installing means includes a toner cartridge moving mechanism and at least one drive motor for driving the toner cartridge moving mechanism.

According to yet another aspect of the present invention, the determination means determines that the toner cartridge may not be properly installed when a drive current of the drive motor exceeds a predetermined level.

According to yet another aspect of the present invention, the determination means includes a detection slot, the detection slot being engagable with a detection member disposed on an outer surface of the toner cartridge.

According to yet another aspect of the present invention, an apparatus for determining whether a toner cartridge is properly installed in an image forming device includes a toner cartridge installation unit connected to a toner hopper of an image forming device, the toner cartridge installation unit defining a space in which a toner cartridge is housed, and the toner cartridge installation unit further including a first drive motor for moving the toner cartridge between a mount/dismount position to an installed position within the image forming device. A drive current flowing through the first drive motor during toner cartridge installation is monitored by an installation monitor, and the toner cartridge installation is halted and the toner cartridge is returned to the mount/dismount position when the installation monitor determines the drive current to be over a predetermined level.

According to yet another aspect of the present invention, the toner cartridge installation unit further includes a switch storing unit, said switch storing unit including at least one detection slot and a detection switch.

According to yet another aspect of the present invention, the toner cartridge includes a detection member, the detection member engaging with the detection slot and activating the detection switch when the toner cartridge is properly installed in the toner cartridge installation unit.

According to yet another aspect of the present invention, the drive current will increase over a predetermined level when the detection member is prevented from engaging with the detection slot during toner cartridge installation.

According to yet another aspect of the present invention, the installation monitor includes a control unit and an input/output device, and the installation monitor is connected to a mount/dismount switch, the detection switch, the first drive motor and a second drive motor.

According to yet another aspect of the present invention, the mount/dismount switch is disposed on an interior wall of the toner installation unit.

According to yet another aspect of the present invention, the toner cartridge installation unit further includes a first gear and a second gear, the first gear and the second gear each having a pin attached thereto.

According to yet another aspect of the present invention, the toner cartridge further includes a first cam groove and a second cam groove, the first cam groove and the second cam groove engaging with the pins.

According to yet another aspect of the present invention, the first gear and the second gear are rotated by the first drive motor.

According to yet another aspect of the present invention, the toner cartridge further includes at least one seal film and a seal film rod, the seal film sealing an opening to the toner cartridge, and the seal film being attached to the seal film rod.

According to yet another aspect of the present invention, the seal film rod further includes a third gear attached to one end thereof, the third gear engages with the second drive motor when the toner cartridge is properly installed in the toner cartridge installation unit, and the seal film rod is rotated by the second drive motor in order to remove the seal film from the opening in the toner cartridge.

These and other objects, features, aspects and advantages of the present invention will become more fully apparent from the following detailed description of the present invention when taken in conjunction with the accompanying drawings, where like reference numerals denote corresponding parts throughout.

DETAILED DESCRIPTION OF THE PREFERRED EMBODIMENTS

Figure 1:
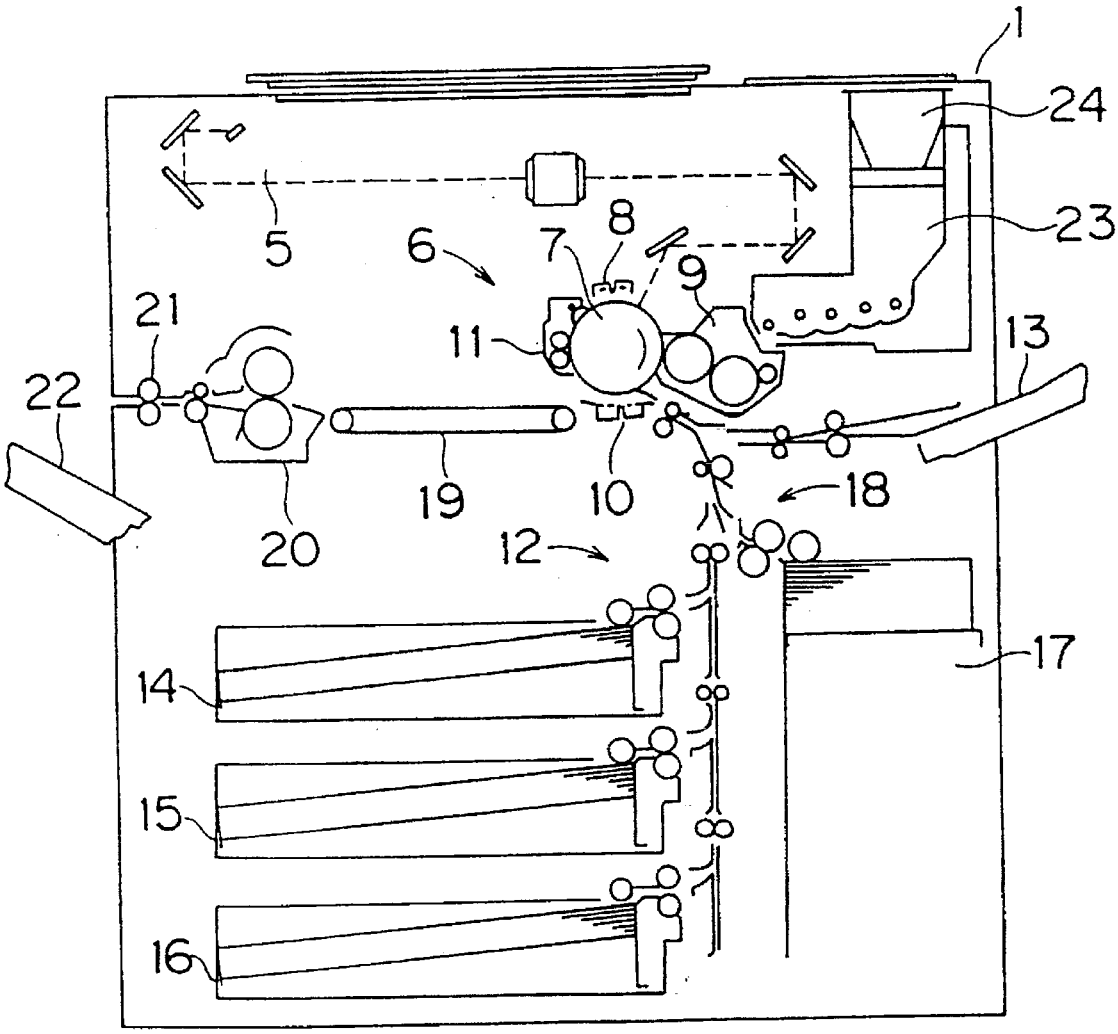
FIG. 1 is a fragmentary, part schematic side view of a copying machine which includes an embodiment of the present invention.

A copying machine having a toner cartridge installation device in accordance with one embodiment of the present invention is shown in FIG. 1. It is to be understood, however, that this invention is not limited to use in a copying machine, but can also be utilized in devices such as facsimile machines and laser printers.

The upper portion of copying machine 1 includes an optical exposure system 5 for optically reading an original document, and includes a light source, mirrors and lens unit. Located in the central portion of the copying machine 1 is an image processor 6 for forming an toner image of the original document on a blank sheet of paper. The image processor 6 includes a photosensitive drum 7, on the outer circumference of which an electrostatic latent image is formed. Surrounding the photosensitive drum 7, there is a main charger 8 for charging the photosensitive drum 7 with a predetermined level of electric charge, a developing device 9 for developing the electrostatic latent image, a transfer-separation device 10 for transferring a toner image to a sheet of paper and separating the sheet from the photosensitive drum 7, and a cleaning device 11 for removing excess toner from the photosensitive drum 7.

A paper supply unit 12 is located in the lower portion of the copying machine 1. This paper supply unit 12 includes a bypass table 13 which is disposed on the right side of the copying machine 1 in FIG. 1, three paper cassettes 14, 15 and 16 arranged perpendicular to the bottom portion of copying machine 1, an oversized paper cassette 17, and a paper transporting device 18 for transferring the sheets stored in the bypass table 13 or paper cassettes 14–17 to the image processor 6. FIG. 1 further shows a discharge belt 19 for transferring the paper sheet to the left side of the machine in FIG. 1, a fixing device 20 for fusing and fixing toner images formed onto the paper sheet, a discharging roller 21 for discharging the paper sheet from the copying machine 1, and a discharger paper tray 22 for accommodating the discharged sheet.

The developing device 9 is provided with a toner hopper 23 for supplying toner. A toner cartridge 24 is detachably connected to the toner hopper 23.

Figure 2:
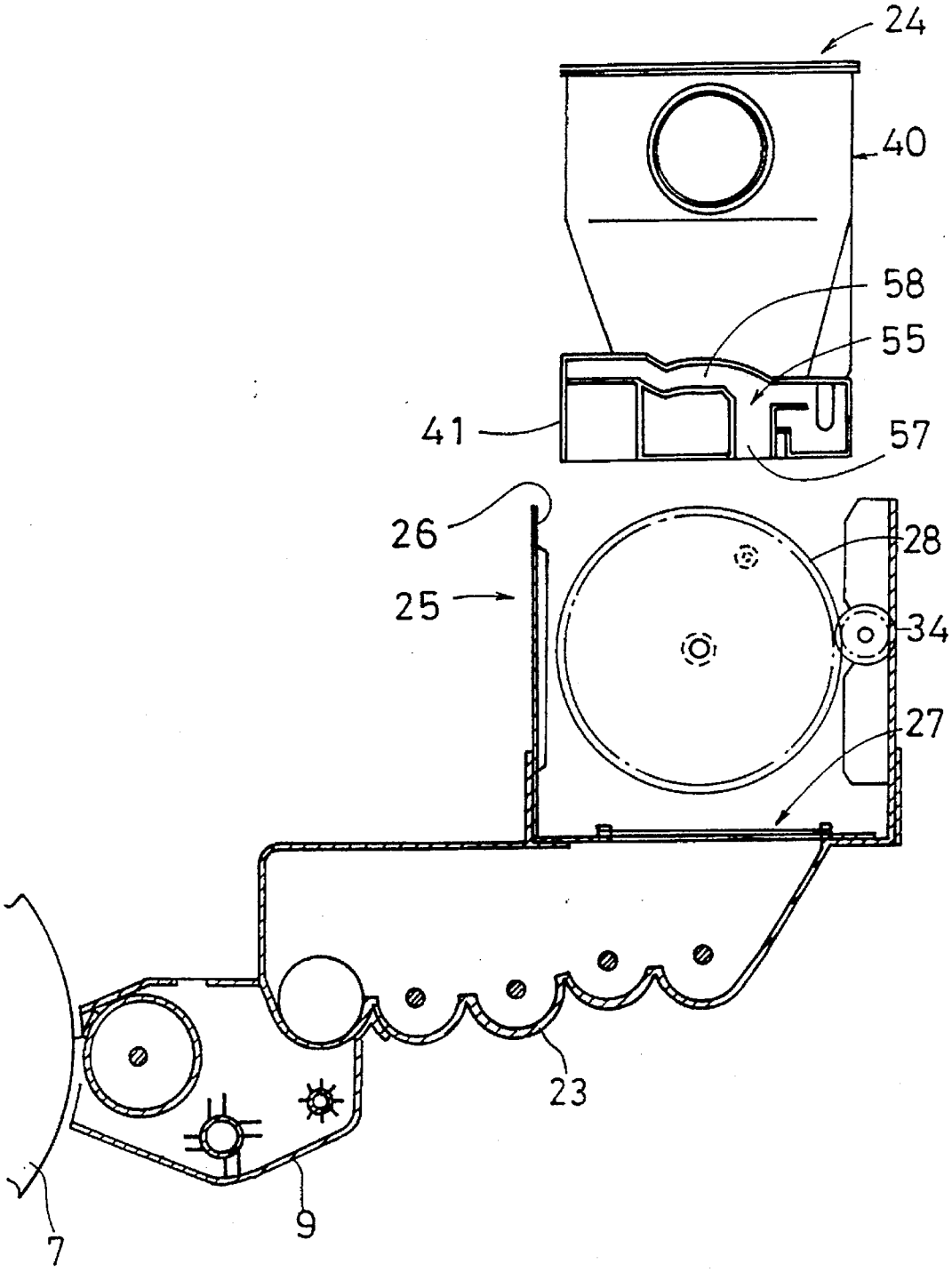
FIG. 2 shows a fragmentary, part sectional, part elevational view of several elements of the copying machine depicted in FIG. 1, on an enlarged scale, the elements including a photosensitive drum, a toner hopper, a toner cartridge installation unit, and a toner cartridge, the toner cartridge shown removed from the toner cartridge installation unit.

As shown in FIG. 2, the toner hopper 23 is provided with a toner cartridge installation unit 25. The toner cartridge installation unit 25 defines an space for mounting or dismounting the toner cartridge 24. A toner cartridge engagement portion 27 is formed at the bottom portion of the toner cartridge installation unit 25 and is engagable with the bottom portion of the toner cartridge 24.

Figure 3:
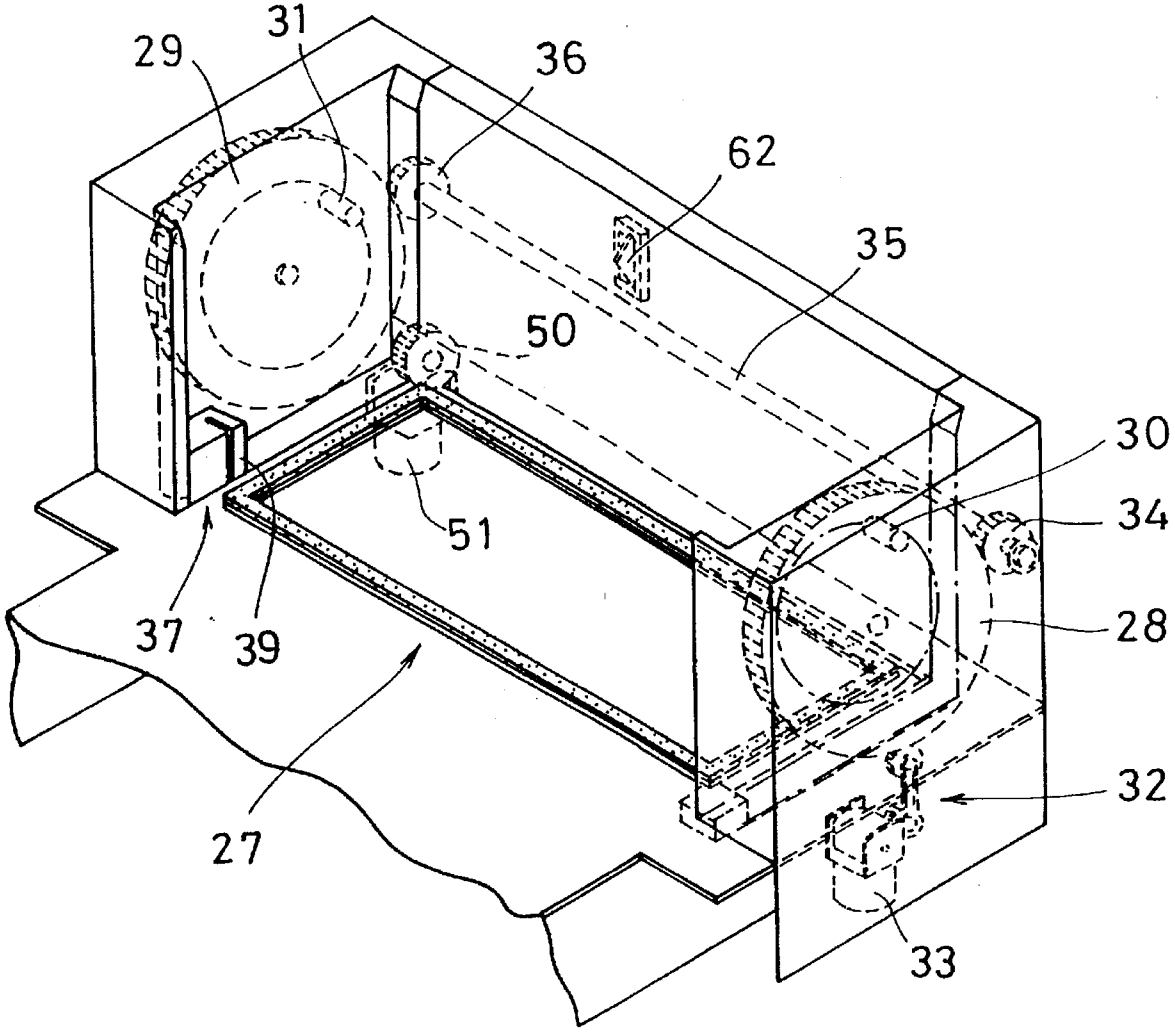
FIG. 3 is a fragmentary, perspective view of the toner cartridge installation unit depicted in FIG. 2, with various elements shown in phantom.

As can be seen in FIGS. 2 and 3, the toner cartridge installation unit 25 includes a first gear 28 and a second gear 29, both of which are rotatably supported on opposing side walls of the toner cartridge installation unit 25. The inner surfaces of the first gear 28 and second gear 29 include a first pin 30 and a second pin 31, which project toward the interior of the toner cartridge installation unit 25.

The first gear 28 is engaged with a first drive motor 33 through a power transfer mechanism 32. The second gear 29 is engaged with the first gear 28 through a third gear 34, a rotation rod 35, and a fourth gear 36, and rotates in synchronism with the first gear 28 in accordance with the power transfer mechanism 32.

Figure 4:
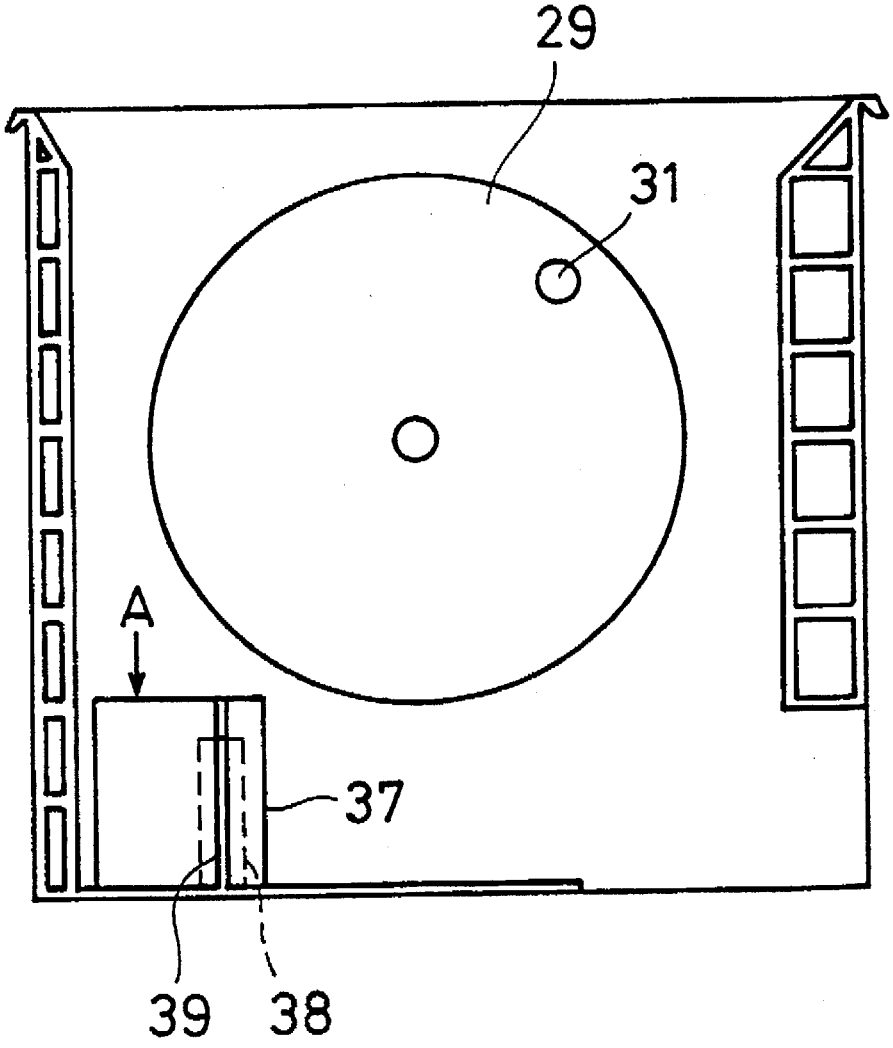
FIG. 4 is a side schematic view of the toner cartridge installation unit depicted in FIG. 3.

The toner cartridge installation device 25 is further provided with a switch storing unit 37, which is located adjacent to the toner cartridge engagement portion 27 and houses a detection switch 38. The switch storing unit 37, as shown in FIG. 4, is generally square, and projects inward within the toner cartridge installation unit 25. The switch storing unit 37 includes a detection slot 39, which is placed in a predetermined position in accordance with the model of copying machine. The detection switch 38 acts as a means for detecting whether the proper toner cartridge has been inserted into the copying machine 1.

As shown in FIG. 3, a mount/dismount switch 62 for detecting whether the toner cartridge 24 is in an initial mount/dismount position is provided on an inner wall of the toner cartridge installation device 25.

Figure 6:
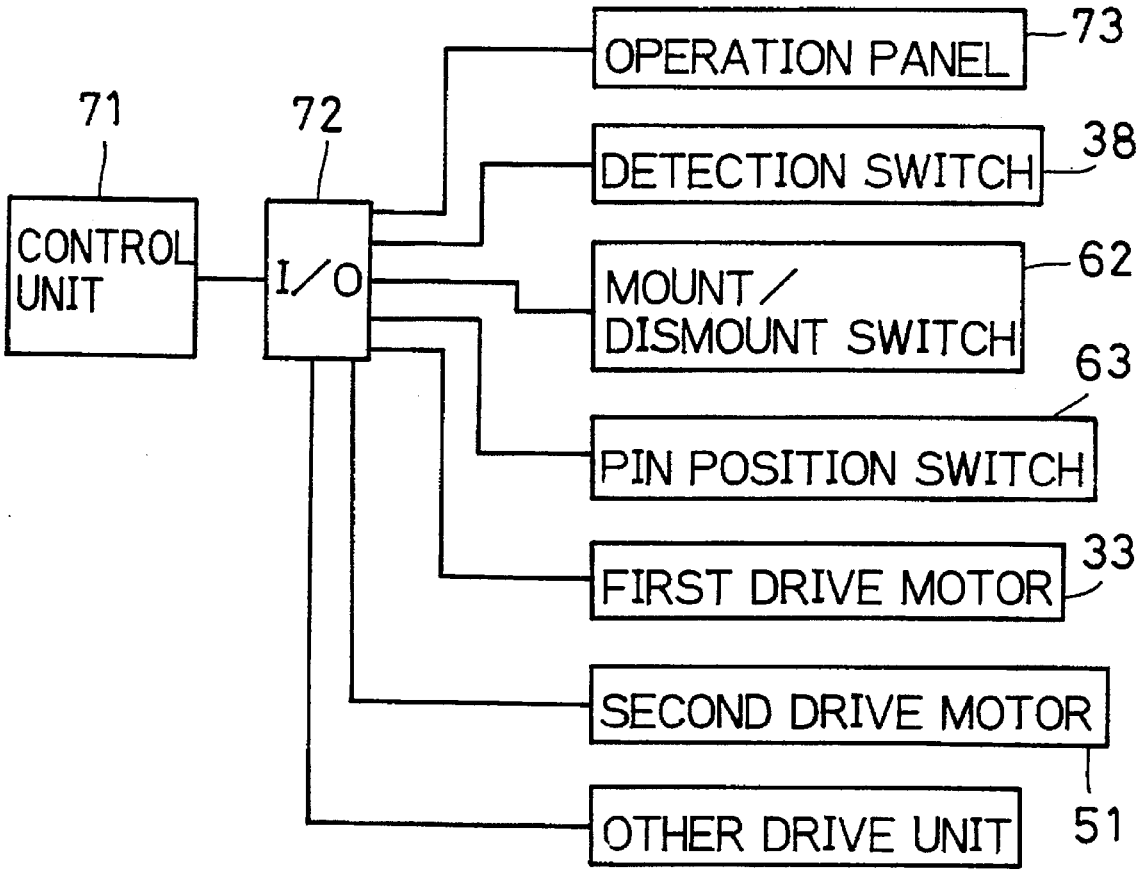
FIG. 6 is a block diagram illustrating a control unit, an I/O interface, and peripheral devices of the copying machine depicted in FIG. 1.

A pin position switch 63 (not shown in FIG. 3, but is shown in FIG. 6) is also included with the toner cartridge installation device 25, and detects whether the first and second pins 30 and 31 are located in a proper position with respect to the toner cartridge 24.

Figure 5:
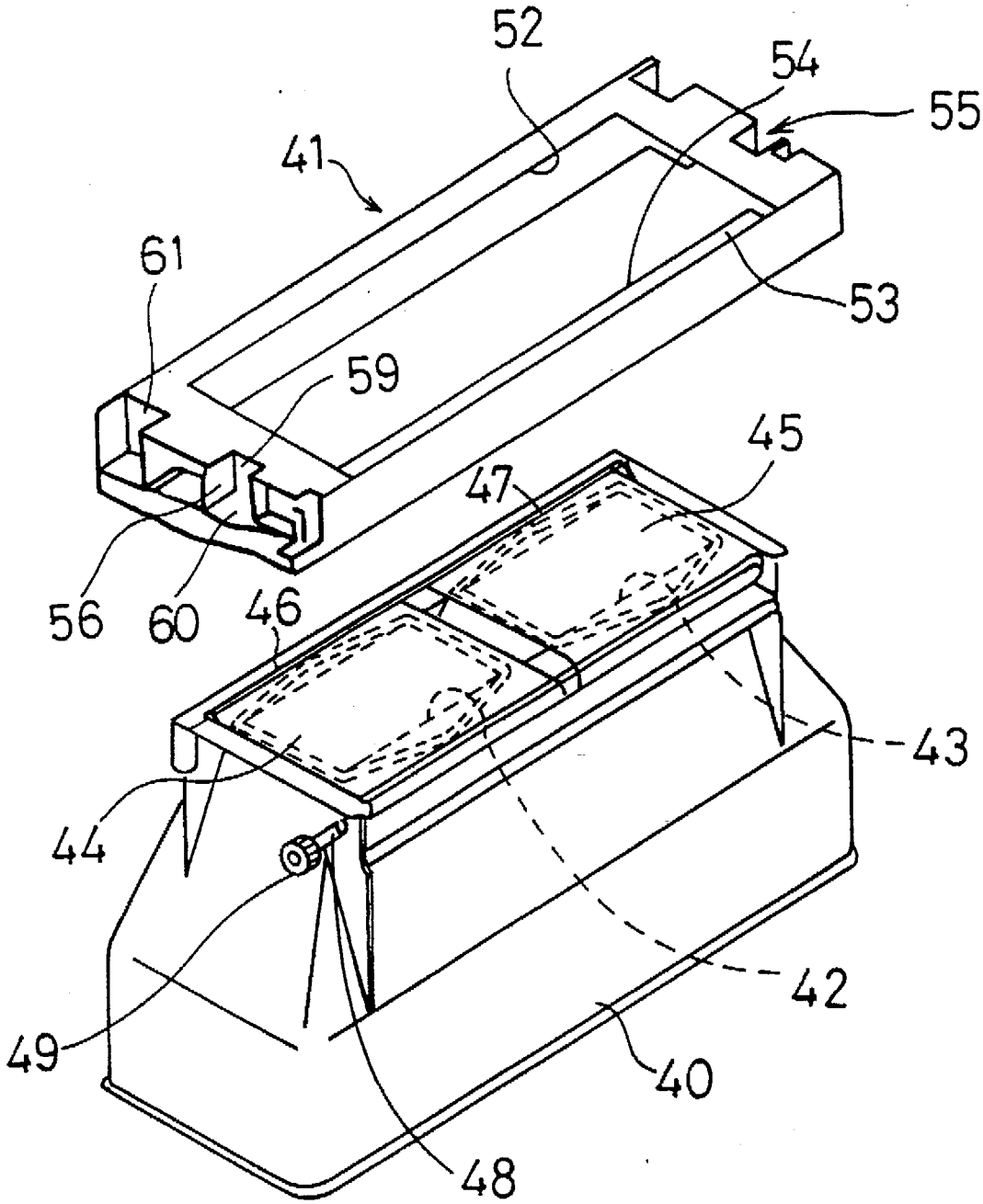
FIG. 5 is a fragmentary, exploded perspective view of the toner cartridge depicted in FIG. 2.

As shown in FIG. 5, the toner cartridge 24 includes a case body 40, and an installation member 41 attached to the bottom portion of the case body 40. The case body 40 is generally rectangular in shape, and tapers down to form a first chute 42 and a second chute 43 for dispensing toner into the toner hopper 23. A first seal film 44 and a second seal film 45 are attached to the first chute 42 and second chute 43, respectively. The first and second seal films 44 and 45 are detachably adhered to the edges of the first and second chutes 42 and 43, and one end of each of the first and second seal films are folded under first and second turning parts 46 and 47.

A seal film rod 48 extends along the interior width of the case body 40 and is rotatably supported thereby. An end of each of the first and second seal films 44 and 45 are adhered to the outer circumference of the seal film rod 48 such that the first and second seal films 44 and 45 can be rolled around the seal film rod 48 by rotating the same.

An end portion of the seal film rod 48 extends outside the case body 40 and is fixed to a fifth gear 49. When the toner cartridge 24 is properly installed in the toner cartridge installation device 25, the fifth gear 49 engages with a sixth gear 50 (shown in FIG. 2) rotatably supported by the toner cartridge installation device 25, and is rotatably driven by a second drive motor 51.

The installation member 41 is generally rectangular in shape, and includes an toner discharge opening 52 corresponding to the first and second chutes 42 and 43. A flange 53 projects inward and is formed to be adjacent to the seal film rod 48 when attached to the toner cartridge 24. At a front portion of the flange 53, a film cleaning member 54 is disposed, which removes toner adhered on the surface of the first and second seal films 44 and 45 when the first and second seal films 44 and 45 are rolled up and removed from the first and second chutes 42 and 43. The film cleaning member 54 may be composed of a resilient material such as sponge.

First and second cam grooves 55 and 56 are formed on opposing sides of the installation member 41, and respectively engage with the first and second pins 30 and 31 of the toner cartridge installation device 25. As shown in FIG. 2, the first cam groove 55 includes a first mount/dismount groove 57 that extends vertically, and an first installation groove 58 that extends generally horizontally. The second cam groove 56 is configured to be symmetrically identical to the first cam groove 55, and includes a second mount/dismount groove 59 and an second installation groove 60 as shown in FIG. 5.

FIG. 5 also shows a detection member 61 formed generally adjacent to the second cam groove 56. The detection member 61 engages with the detection slot 39 of the switch storing unit 37 when the toner cartridge 24 is properly installed in the toner cartridge installation device 25. The position where the detection member 61 is formed on the installation member 41 is determined according to the model of the copying machine.

As shown in FIG. 6, the copying machine 1 includes a control unit 71, which includes a microcomputer system comprising one or more CPU, RAM and ROM units and various kinds of drivers. The control unit 71 is connected with an input/output interface 72. The input/output interface 72 is connected with an operation panel 73 which is typically disposed on the upper surface of the copying machine 1. The operation panel 73 includes a print key to begin printing, number keys to set the number of copies desired, a toner cartridge key to instruct the installation or removal of the toner cartridge, as well as other instruction keys. A display panel, such as a liquid crystal display panel, displays the operating information to the user.

The input/output interface 72 is further connected to the first drive motor 33, the second drive motor 51, the detection switch 38, the mount/dismount switch 62, and the pin position switch 63, as well as other drive units.

Figure 7:
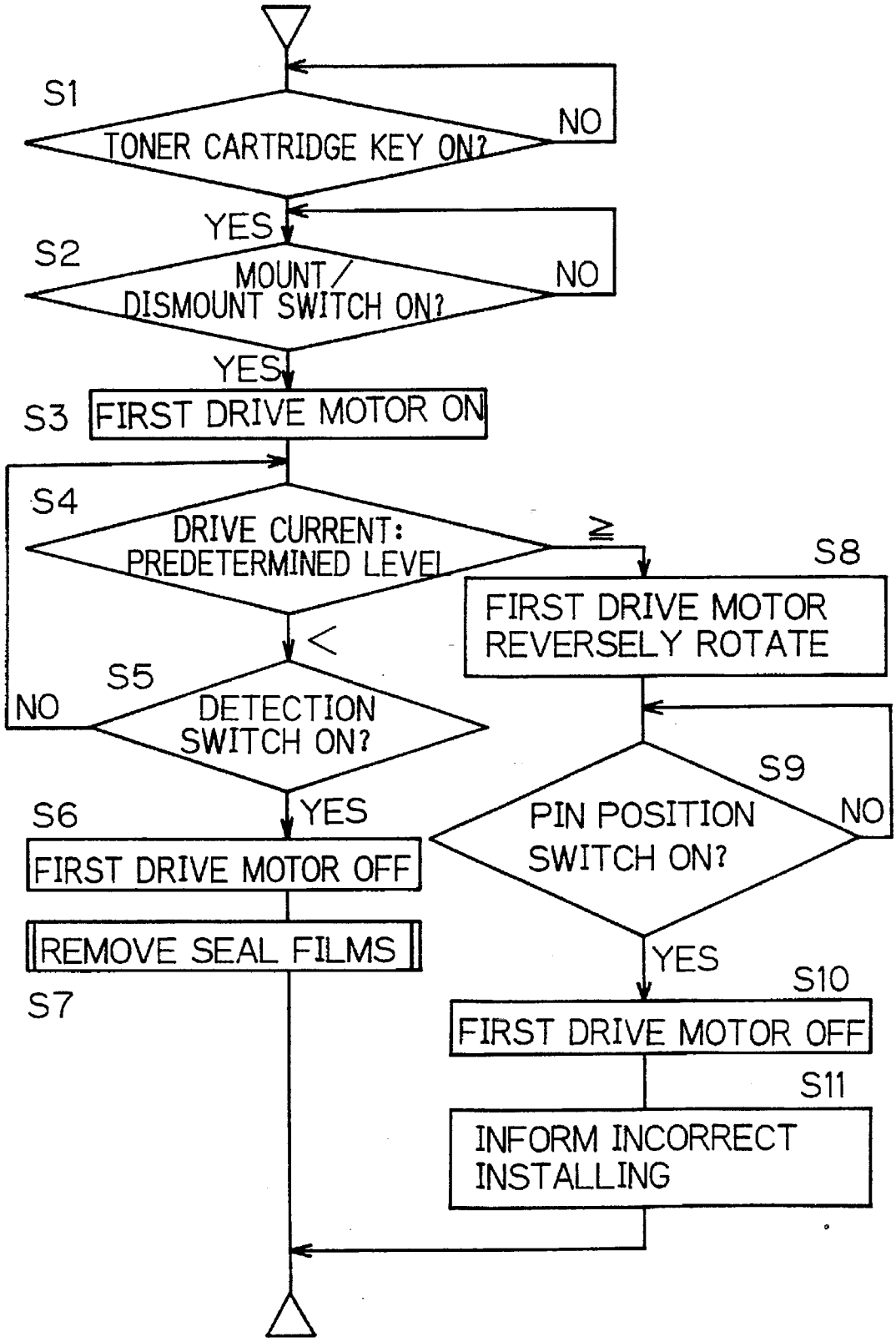
FIG. 7 is a flow chart showing the toner cartridge installation control process for the copying machine depicted in FIG. 1.

The operation of the toner cartridge in accordance with the present invention will now be described with reference to the flowchart shown in FIG. 7.

At step S1, it is determined whether the toner cartridge key on the operation panel 73 is pressed. If so, the program runs to step S2, at which time it is determined whether the mount/dismount switch 62 is "ON". The mount/dismount switch 62 will be in the "ON" position if the toner cartridge 25 has been inserted into the opening 26 of the toner cartridge installation device 25.

Figure 8:
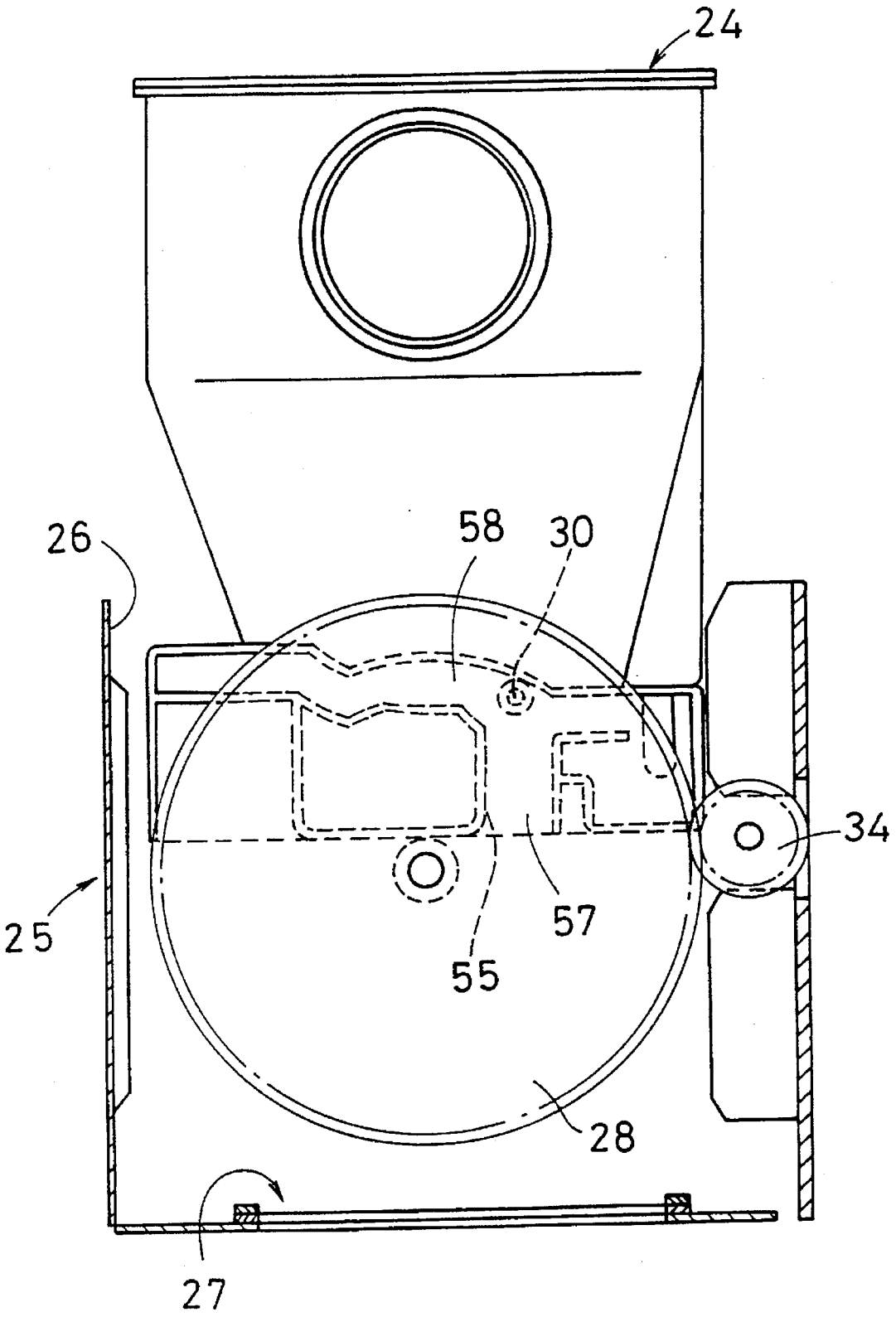
FIG. 8 is a part cross-sectional, part elevational view of the toner cartridge installation unit and the toner cartridge depicted in FIG. 2, showing the position of the toner cartridge in the beginning of the toner cartridge installation process.

As is partially shown in FIG. 8, when the toner cartridge 24 is inserted into the opening 26 of the toner cartridge installation device 25, the toner cartridge 24 is positioned such that the first and second pins 30 and 31 are inserted into the upper portion of the first and second mount/dismount grooves 57 and 59. In this position, a side surface of the toner cartridge 24 presses against the mount/dismount switch 62 (not shown) and allows the presence of the toner cartridge 24 to be detected.

Turning again to FIG. 7, if the mount/dismount switch 62 is determined to be "ON" at step S2, the program runs to step S3. At step S3, a control signal is given to the first drive motor 33, and the first and second gears 28 and 29 are then rotated in the clockwise direction (in FIG. 8).

Figure 9:
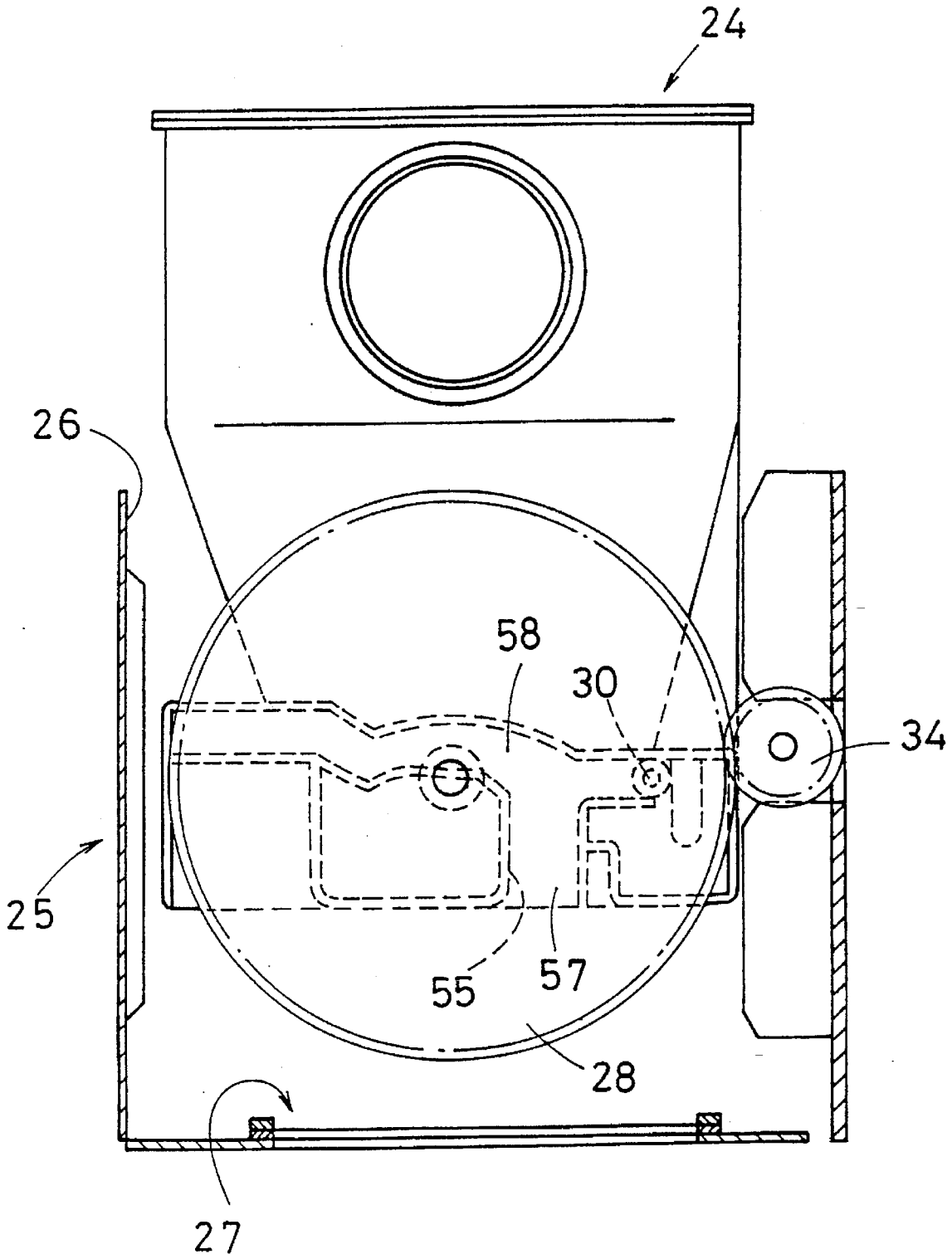
FIG. 9 is a part cross-sectional, part elevational view of the toner cartridge and the toner cartridge installation unit similar to that depicted in FIG. 8, showing the position of the toner cartridge during the toner cartridge installation process.

As shown in FIG. 9, after the partial rotation of the first and second gears 28 and 29, the first and second pins 30 and 31 are positioned at one end of each of the first and second installation grooves 58 and 60 and the toner cartridge is lowered further into the toner cartridge installation unit 25. First and second gears 28 and 29 continue to rotate in the clockwise direction, and the toner cartridge 24 continues to lower into the toner cartridge installation unit 25, until the bottom of the toner cartridge 24 is level with the top of the switch storage unit 37.

Turning again to FIG. 7, after the first drive motor 33 begins to turn the first and second gears 28 and 29, the installation process moves to step S4. At step S4 the level of the drive current flowing through the first drive motor 33 is monitored while installation proceeds.

If an improper toner cartridge has been inserted into the toner cartridge installation device 25, the detection member 61 on the toner cartridge 24 will not be aligned with the detection slot 39, and thus when the toner cartridge 24 is lowered down to the vicinity of the switch housing unit 37, the detection member 61 will abut against the outer portion thereof (see arrow A in FIG. 4). This will cause the drive current in the first drive motor 33 to increase because the first and second gears 28 and 29 can no longer rotate.

In this situation, the first drive motor 33 will be overloaded and the drive current would increase beyond a predetermined level. Therefore, at step S4, once the level of the drive current is determined to be over the predetermined level, the program runs to step S8.

Turning again to FIG. 7, at step S8 the rotation of the first drive motor 33 is reversed. It is then determined at step S9 whether the pin position switch 63 is "ON", i.e., whether the first and second pins 30 and 31 are properly positioned. If the pin position switch 63 is "ON", the program runs to step S10. In step S10, the first drive motor 33 is halted. In this step, the toner cartridge 24 is located in the position shown in FIG. 8 and can be dismounted. In step S11, the operation panel 73 informs the user that the toner cartridge is unsuitable for that model of copying machine or that some obstruction to installation exists.

If the proper toner cartridge 24 has been selected for installation, or no other impediment to installation exists, the toner cartridge 24 will lowered down into the toner cartridge installation unit 25 until the detection member 61 slides into the detection slot 39. When this occurs, the detection switch 38 will be placed into the "ON" position.

Because the level of the drive current in the first drive motor 33 will be at or less than the predetermined level, the program will run to step S5. At step S5 it is determined whether the detection switch 38 is "ON". If so, the program runs to step S6.

Figure 10:
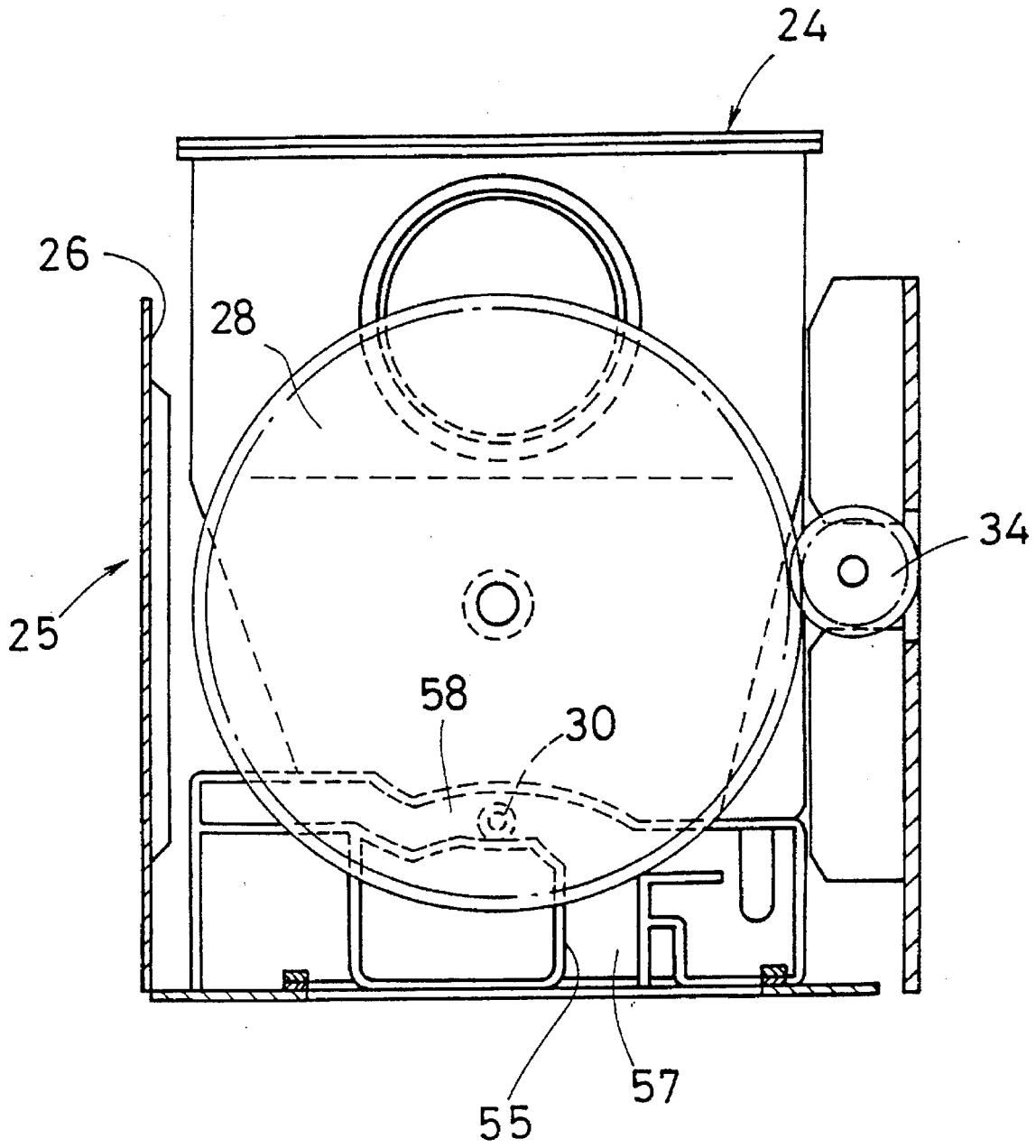
FIG. 10 is a part cross-sectional, part elevational view of the toner cartridge and the toner cartridge installation unit similar to that depicted in FIGS. 8 and 9, showing the position of the toner cartridge when installation has been successfully completed.

In step S6, the first drive motor 33 is halted. In this state, as shown in FIG. 10, the toner cartridge 24 is attached to the toner cartridge engagement portion 27 of the toner cartridge installation unit 25.

At step S7, a control signal is sent to the second drive motor 51, and the first and second seal films 44 and 45 are removed from the first and second chutes 46 and 47 and rolled around the seal film rod 48, which allows toner to flow into the toner hopper 23.

The procedure described above will also serve to alert the user to the presence of any foreign objects in the toner cartridge installation unit 25 which prevent the toner cartridge 24 from being installed properly. For example, if a pen or pencil has accidentally fallen into the toner cartridge installation unit 25, and a user attempts to install a toner cartridge, it is likely that the detection switch 38 will not be activated by the detection member 61. This will activate the procedure described above, and will alert the user that the toner cartridge cannot be installed properly.

Figure 11:
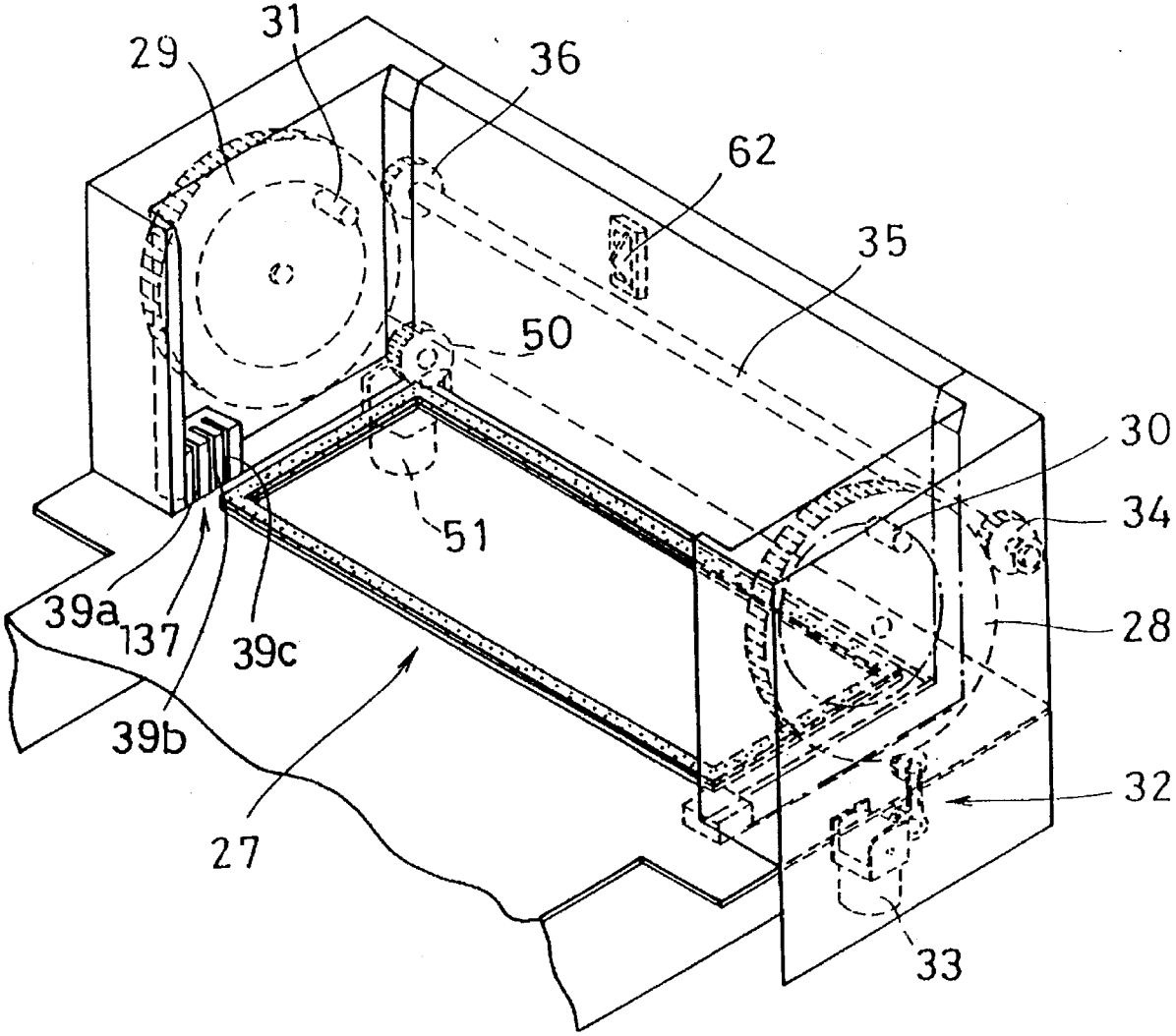
FIG. 11 is a fragmentary, perspective view of a toner cartridge installation device similar to that depicted in FIG. 3, showing another embodiment of the switch storage unit.
Figure 12:
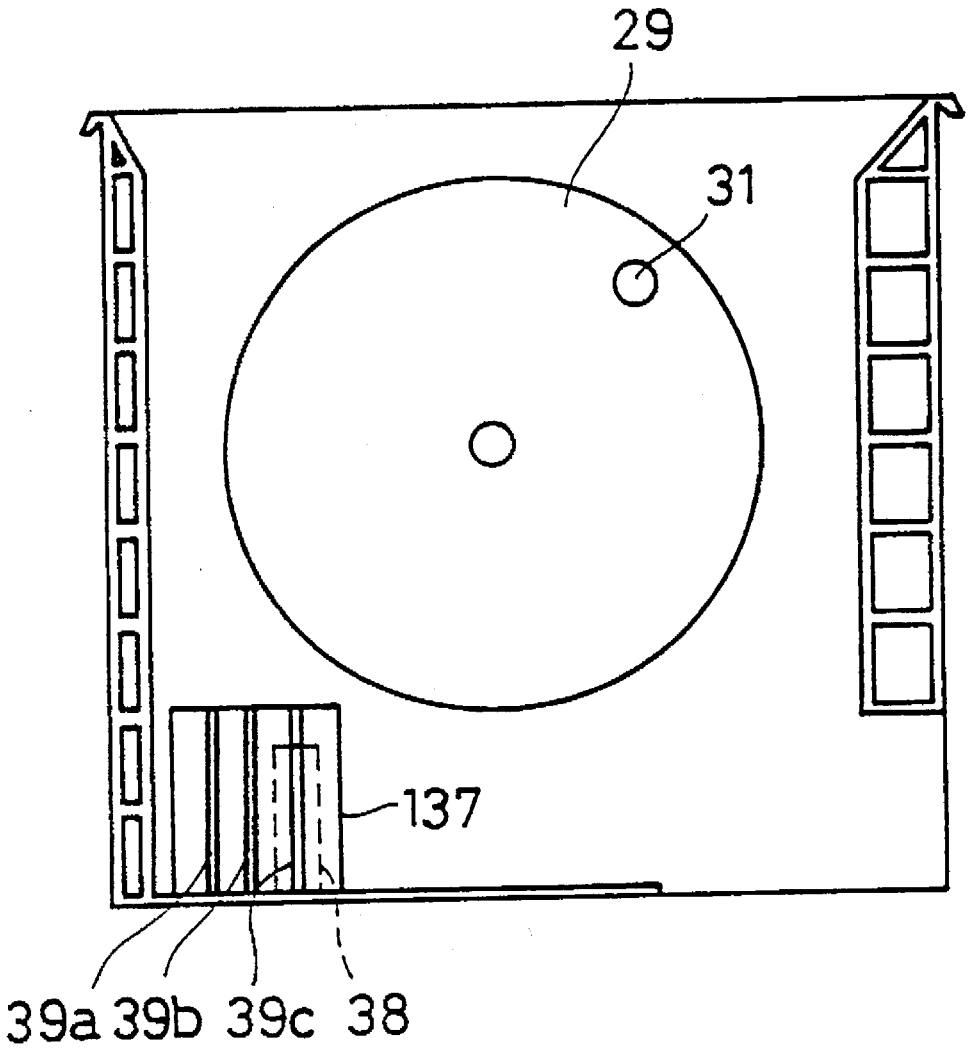
FIG. 12 is a side schematic view of a toner cartridge installation device similar to that depicted in FIG. 4, showing the embodiment of the switch storage unit depicted in FIG. 11.

Another embodiment of the present invention is shown in FIGS. 11 and 12.

In this embodiment, the copying machine 1 and the toner cartridge installation unit 25 are generally the same as the embodiment described above. However, in this embodiment a switch storing unit 137 is disposed in the toner cartridge installation unit 25. The switch storing unit 137 includes three detection slots 39*a*, 39*b* and 39*c*. The detection switch 38 is disposed inside one of the three detection slots 39*a*, 39*b*, and 39*c*, in accordance with the model of the copying machine 1. As can be seen in FIG. 12, the switch storing unit 137 has the detection switch 38 disposed in detection slot 39*c*.

When a plurality of detection slots are provided on the switch storing unit 137, it is possible to allow a number of different types of toner and/or toner cartridges to be used with the copying machine 1, while protecting against the use of improper toner and/or toner cartridges.

In the above embodiments, an attempt to insert an unsuitable toner cartridge into the toner cartridge installation unit 25 will be detected, and the unsuitable toner cartridge will be automatically dismounted. This arrangement allows the proper toner to be matched with the proper copying machine, which will insure that an optimal image is formed. Moreover, the operation panel 73 on the copying machine 1 immediately informs the user that he or she is using the wrong toner cartridge, thus preventing less than optimal copying or possible damage to the copying machine 1.

The above embodiments will also alert the user to the presence of foreign objects within the toner cartridge installation unit 25 which prevent the toner cartridge 24 from being properly installed, thus preventing damage.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed:

1. An apparatus for installing a toner cartridge in an image forming device, comprising:

a toner cartridge installing means, for moving a toner cartridge from a mount/dismount position in an image forming device into an installed position in said image forming device;

a determination means for determining whether said toner cartridge is properly installed in said image forming device; and a toner cartridge discharging means for returning said toner cartridge back to said mount/dismount position in response to said determination means determining that said toner cartridge is not properly installed in said image forming device.

2. The apparatus of claim 1, wherein said toner cartridge installing means includes a toner cartridge moving mechanism and at least one drive motor for driving said toner cartridge moving mechanism.

3. The apparatus of claim 2, wherein said determination means determines that said toner cartridge is not installed properly when a drive current of said drive motor exceeds a predetermined level.

4. The apparatus of claim 1, wherein said determination means includes a detection slot, said detection slot engagable with a detection member disposed on an outer surface of said toner cartridge.

5. An apparatus for determining whether a toner cartridge is properly installed in an image forming device, comprising:

a toner cartridge installation unit connected to a toner hopper of an image forming device, said toner cartridge installation unit defining a space for insertion of a toner cartridge, and said toner cartridge installation unit further including a first drive motor for moving said toner cartridge between a mount/dismount position to an installed position within said space;

wherein a drive current flowing through said first drive motor during toner cartridge installation is monitored by an installation monitor, such that during said toner cartridge installation said drive motor is halted and said toner cartridge is returned to said mount/dismount position in response to said installation monitor determining said drive current to be over a predetermined level.

6. The apparatus of claim 5, wherein said toner cartridge installation unit further includes a switch storing unit, said switch storing unit including at least one detection slot and a detection switch.

7. The apparatus of claim 6, wherein said toner cartridge includes a detection member, said detection member engaging with said detection slot and activating said detection switch in response to proper installation of said toner cartridge in said toner cartridge installation unit.

8. The apparatus of claim 6, wherein said installation monitor includes a control unit and an input/output device, and said installation monitor is connected to a mount/dismount switch, said detection switch, said first drive motor and a second drive motor.

9. The apparatus of claim 8, wherein said mount/dismount switch is disposed on an interior wall of said toner installation unit.

10. The apparatus of claim 5, wherein said toner cartridge installation unit further includes a first gear and a second gear, said first gear and said second gear each having a pin attached thereto.

11. The apparatus of claim 10, wherein said toner cartridge further includes a first cam groove and a second cam groove, said first cam groove and said second cam groove engaging with said pins attached to said first gear and said second gear.

12. The apparatus of claim 10, wherein said first gear and said second gear are rotated by said first drive motor.

13. The apparatus of claim 5, wherein said toner cartridge further includes at least one seal film and a seal film rod, said seal film sealing an opening to said toner cartridge, and said seal film attached to said seal film rod.

14. The apparatus of claim 13, wherein said seal film rod further includes a third gear attached to one end thereof;

said third gear engages with said second drive motor when said toner cartridge is properly installed in said toner cartridge installation unit; and said seal film rod is rotated by said second drive motor in order to remove said seal film from said opening in said toner cartridge.

* * * * *